US007896137B2

(12) United States Patent
Ishikawa

(10) Patent No.: US 7,896,137 B2
(45) Date of Patent: Mar. 1, 2011

(54) ELEVATOR POWER SYSTEM HAVING PLURAL STORAGE APPARATUSES

(75) Inventor: Junichiro Ishikawa, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 757 days.

(21) Appl. No.: 11/909,771

(22) PCT Filed: Apr. 1, 2005

(86) PCT No.: PCT/JP2005/006488

§ 371 (c)(1),
(2), (4) Date: Sep. 26, 2007

(87) PCT Pub. No.: WO2006/114820

PCT Pub. Date: Nov. 2, 2006

(65) Prior Publication Data

US 2010/0187045 A1 Jul. 29, 2010

(51) Int. Cl.
*B66B 1/28* (2006.01)

(52) U.S. Cl. ..... 187/290; 187/393

(58) Field of Classification Search ..... 187/247, 187/288, 290, 293, 391–393; 320/104, 107–110
See application file for complete search history.

(56) References Cited

U.S. PATENT DOCUMENTS

| | | | | |
|---|---|---|---|---|
| 4,346,789 | A * | 8/1982 | Ekholm | 187/382 |
| 5,568,036 | A * | 10/1996 | Hulsey et al. | 320/108 |
| 6,408,986 | B1 * | 6/2002 | Ayano et al. | 187/290 |
| 6,626,267 | B2 * | 9/2003 | Beus et al. | 187/290 |
| 6,732,839 | B2 * | 5/2004 | Schuster | 187/391 |
| 7,104,363 | B2 * | 9/2006 | Mori et al. | 187/290 |

FOREIGN PATENT DOCUMENTS

| | | |
|---|---|---|
| JP | 57 112275 | 7/1982 |
| JP | 2000 318939 | 11/2000 |
| JP | 2001 139242 | 5/2001 |
| JP | 2001 302120 | 10/2001 |
| JP | 2002 68615 | 3/2002 |
| JP | 2002 249285 | 9/2002 |
| JP | 2002 338175 | 11/2002 |
| JP | 2003 54849 | 2/2003 |
| WO | 02 057171 | 7/2002 |

* cited by examiner

*Primary Examiner*—Jonathan Salata
(74) *Attorney, Agent, or Firm*—Oblon, Spivak, McClelland, Maier & Neustadt, L.L.P.

(57) ABSTRACT

A power supplying system for an elevator includes: a first electric storage apparatus for storing thereinto electric power derived from a commercial power supply; a charging apparatus for charging the electric power derived from the commercial power supply to the first electric storage apparatus and for controlling a current when the electric power is charged into the first electric storage apparatus; a second electric storage apparatus for storing thereinto electric power used to operate an appliance of an elevator; and a power supplying apparatus for supplying the electric power derived from the first electric storage apparatus to the second electric storage apparatus.

12 Claims, 8 Drawing Sheets

ELEVATOR POWER SYSTEM HAVING PLURAL STORAGE APPARATUSES

TECHNICAL FIELD

The present invention relates to a power supplying system for an elevator for supplying electric power derived from a commercial power supply to an elevator.

BACKGROUND ART

In conventional elevator apparatuses, in order to supply electric power to appliances installed in cars, a method has been proposed in which batteries are mounted on the cars. Power feeders for supplying electric power to the batteries are provided in hoistways. Electric power derived from external power supplies is supplied to the power feeders. When the cars are stopped at the lowermost floors, the electric power derived from the external power supplies is supplied to the batteries by the power feeders (refer to Patent Document 1).

Patent Document 1: JP 2001-302120 A

DISCLOSURE OF THE INVENTION

Problem to be solved by the Invention

In such conventional elevator apparatuses, however, only when the cars are stopped at the lowermost floors, the electric power is supplied from the power feeders to the batteries. As a result, in order that charging operations to the batteries are accomplished within a short time without stopping the cars for a long time, considerably high electric power must be supplied to those batteries. As a consequence, since the electric power derived from the external power supplies is directly charged to the batteries in the conventional elevator apparatuses, variations of amounts of the electric power derived from the external power supplies are increased. Under such the circumstances, maximum demand power of elevators is increased, so that cost of contract demand established with electric power companies and cost required for power facilities are increased.

The present invention has been made to solve the above-mentioned problems, and therefore, has an object to provide a power supplying system for an elevator capable of decreasing variations of amounts of electric power derived from a commercial power supply.

Means for solving the Problems

A power supplying system for an elevator according to the present invention includes: a first electric storage apparatus for storing thereinto electric power derived from a commercial power supply; a charging apparatus for charging the electric power derived from the commercial power supply to the first electric storage apparatus and for controlling a current when the electric power is charged into the first electric storage apparatus; a second electric storage apparatus for storing thereinto electric power used to operate an appliance of an elevator; and a power supplying apparatus for supplying the electric power derived from the first electric storage apparatus to the second electric storage apparatus.

BEST MODE FOR CARRYING OUT THE INVENTION

Referring now to drawings, preferred embodiments of the present invention will be described.

Embodiment 1

Figure 1:
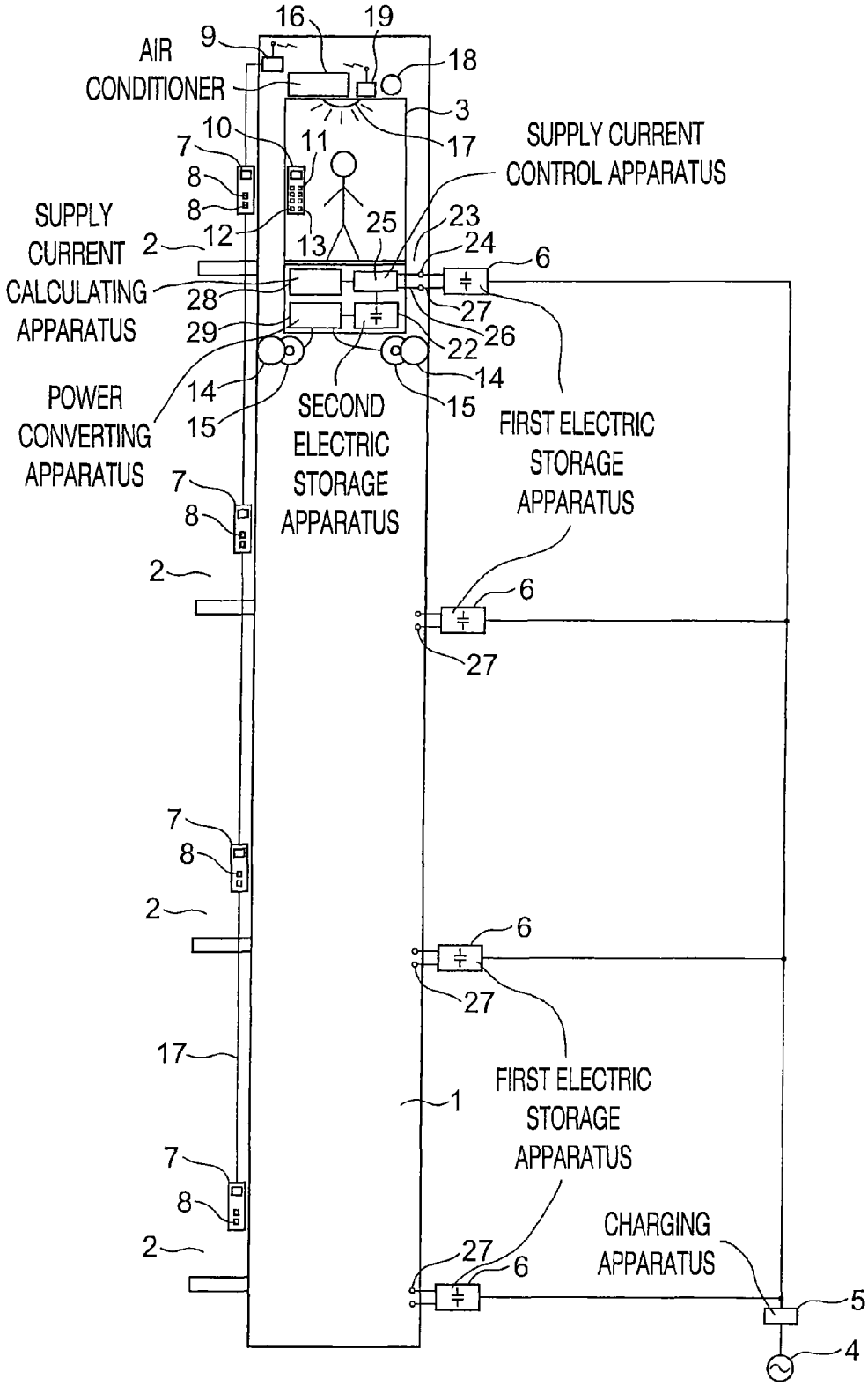
FIG. 1 is a structural diagram for indicating a power supplying system for an elevator, according to a first embodiment of the present invention.
Figure 2:
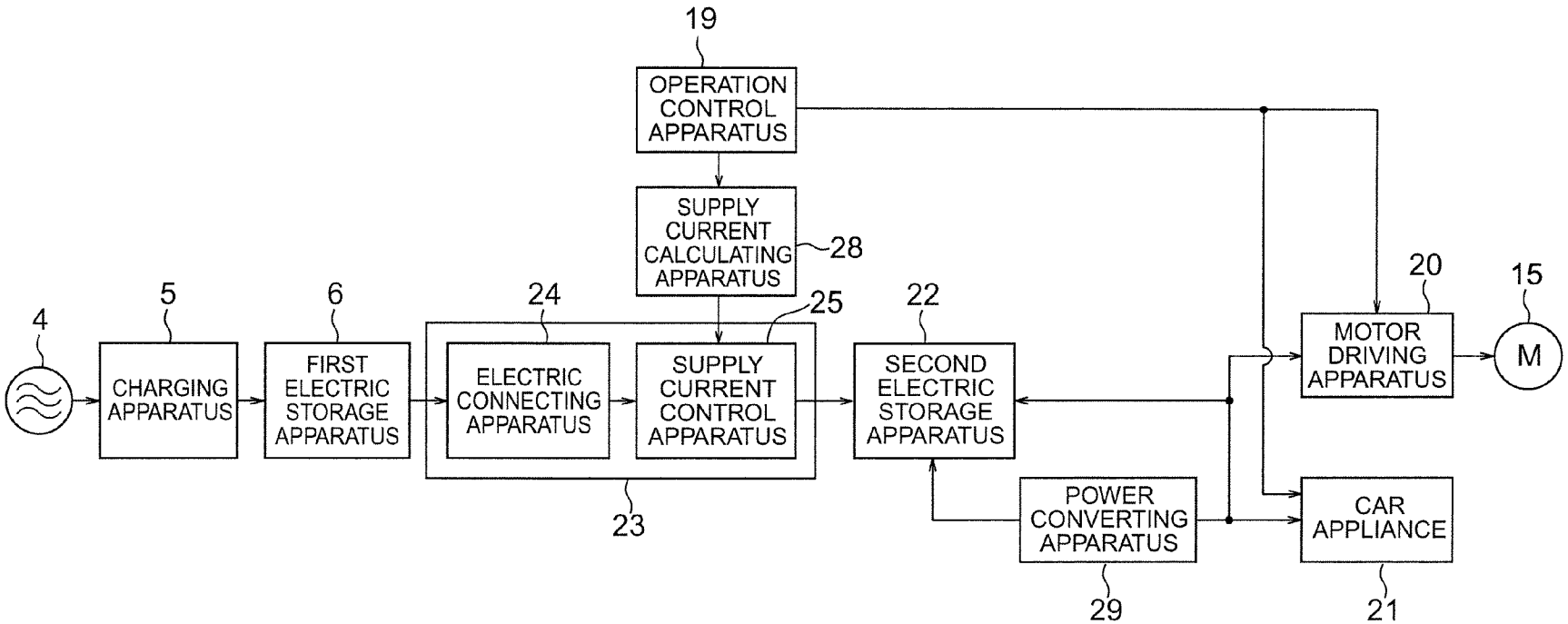
FIG. 2 is a block diagram for showing the power supplying system for an elevator of FIG. 1.

FIG. 1 is a structural diagram for indicating a power supplying system for an elevator, according to a first embodiment of the present invention. Also, FIG. 2 is a block diagram for showing the power supplying system for an elevator of FIG. 1. In the drawing, a hoistway 1 is installed in a building containing a plurality of floors. A car 3 which can be raised/lowered along upper and lower directions is installed in the hoistway 1. The car 3 can land at elevator halls 2 provided for the respective floors. Also, one pair of guide rails (not shown) for guiding the car 3 which is raised/lowered are installed within the hoistway 1.

A charging apparatus 5 for receiving electric power derived from a commercial power supply 4 is provided in the building. A plurality of first electric storage apparatuses 6 installed on the respective floors are electrically connected to the charging apparatus 5. It is assumed that a capacity of each of the first electric storage apparatuses 6 is identical to each other. It should be noted that a capacity indicates an electric power storage capacity in the present patent application. The electric power derived from the commercial power supply 4 is charged by the charging apparatus 5 into each of the first electric storage apparatuses 6. As the first electric storage apparatus 6, for example, batteries, electric double layer capacitors, and the like are employed. Also, the charging apparatus 5 controls currents when the first electric storage apparatuses 6 are being charged by the charging apparatus 5. In this example, the charging apparatus 5 is designed to control charging currents in such a manner that electric power charged into the first electric storage apparatus 6 becomes substantially equal to average consumed electric power of an elevator.

An elevator hall appliance containing a hall operating panel 7 is installed on each of the elevator halls 2. An operation button 8 is provided on each of the hall operating panels 7, while the operation button 8 is operated in order to register a car call. Also, a hoistway built-in appliance containing a position sensor (not shown) for detecting a position of the car 3 is installed within the hoistway 1. A wireless communication apparatus 9 is provided at a summit portion within the hoistway 1, while the wireless communication apparatus 9 is electrically connected to both the elevator hall appliance and the hoistway built-in appliance.

A car operating panel 10 is installed within the car 3. In the car operating panel 10, a plurality of car call buttons 11, a door open button 12, and a door close button 13 are provided. The plurality of car call buttons 11 are operated so as to register a car call. The door open button 12 and the door close button 13 are manipulated in order to open and close an elevator entrance (not shown).

One pair of rollers 14 and one pair of motors 15 are provided at a lower portion of the car 3. The pair of rollers 14 are depressed against the respective guide rails. The pair of motors 15 are employed in order to rotate the respective rollers 14. The respective rollers 14 are rotated on the respective guide rails by drive force of the respective motors 15. As a result, the car 3 is raised/lowered along the respective guide rails within the hoistway 1. In other words, the car 3 is driven in a self-drive system.

An air conditioner 16, a lighting apparatus 17, a door opening/closing apparatus 18, and an operation control apparatus 19 are provided at an upper portion of the car 3. The door opening/closing apparatus 18 opens and closes the elevator entrance. The operation control apparatus 19 controls operations of the elevator. Various sorts of information derived from the elevator hall appliance, the hoistway built-in appliance, and the car operating panel 10 are transmitted to the operation control apparatus 19. The operation control apparatus 19 controls operations of the elevator based upon the various sorts of information derived from the elevator hall appliance, the hoistway built-in appliance, and the car operating panel 10. The information derived from the elevator hall appliance and the hoistway built-in appliance is transmitted to the operation control apparatus 19 through wireless communication by the wireless communication apparatus 9.

The operation control apparatus 19 controls operations of the respective motors 15 through a motor driving apparatus 20 (FIG. 2) so as to control transportations of the car 3. Also, the operation control apparatus 19 controls respective operations of the air conditioner 16, the lighting apparatus 17, and the door opening/closing apparatus 18, which function as a car appliance 21 (FIG. 2).

A second electric storage apparatus 22 is mounted on the car 3, while the second electric storage apparatus 22 is employed to store electric power used to operate the appliances of the elevator. In this example, the electric power which is supplied to the appliances mounted on the car 3, that is, the car operating panel 10, the motors 15, the air conditioner 16, the lighting apparatus 17, the door opening/closing apparatus 18, and the operation control apparatus 19 is stored in the second electric storage apparatus 22. As the second electric storage apparatus 22, for instance, a battery, an electric double layer capacitor, and the like are employed. Also, electric power supplying apparatus 23 is provided to the car 3 and the hoistway 1, while the electric power supplying apparatus 23 supplies the electric power derived from the first electric storage apparatuses 6 to the second electric storage apparatus 22.

The electric power supplying apparatus 23 includes an electric connecting apparatus 24 and a supply current control apparatus 25. The electric connecting apparatus 24 conducts electric power from the first electric storage apparatuses 6 to the car 3. The supply current control apparatus 25 controls a current when the electric power derived from the first electric storage apparatuses 6 is supplied via the electric connecting apparatus 24 to the second electric storage apparatus 22.

The electric connecting apparatus 24 includes a car-side connecting unit 26 provided in the car 3, and a plurality of hoistway-side connecting units 27. The plurality of hoistway-side connecting units 27 are provided to be separated from each other with intervals therebetween along a height direction within the hoistway 1, and these hoistway-side connecting units 27 are made to come into contact with the car-side connecting unit 26 when the car 3 is stopped at a predetermined power supplying position. In other words, the electric power supplying apparatus 23 can supply the electric power derived from the first electric storage apparatus 6 to the second electric storage apparatus 22 only when the car 3 is stopped at the predetermined power supplying position within the hoistway 1. In this example, the position of the car 3 when the car 3 lands at each of the elevator halls 2 is assumed as the predetermined power supplying position.

Also, a supply current calculating apparatus 28 and a power converting apparatus 29 are mounted on the car 3. The supply current calculating apparatus 28 calculates a current value controlled by the supply current control apparatus 25 based upon information derived from the operation control apparatus 19. The power converting apparatus 29 can convert an electric power mode between an electric power mode to be stored in the second electric storage apparatus 22 and an electric power mode for operating an appliance of the elevator.

The supply current calculating apparatus 28 acquires an electric power amount stored in the second electric storage apparatus 22, a travel distance of the car 3 up to a destination floor which is selected by registering a car call, and a stopping time during which the car 3 is stopped at each of the elevator halls 2 from the operation control apparatus 19, and then calculates to obtain a current value for supplying to the second electric storage apparatus 22 based upon the stored electric power amount, the travel distance, and the stopping times, which have been acquired.

Now, a description is made of a charging efficiency in the case where the second electric storage apparatus 22 is an electric double layer capacitor. It is considered that an electric double layer capacitor is substantially equivalent to a circuit in which a capacitive component is electrically connected to a resistive component in series. As a consequence, when electric power is stored in the capacitive component and when electric power is discharged from the capacitive component, a portion of the electric power is consumed in the resistive component as heat. An electric power amount "$E_{LOSS}$" consumed as heat is given by the below-mentioned formula (1), since a charging current is expressed by a function "$i_c(t)$" of a time "t":

[Formula 1]

$$E_{Loss}=\int_0^T R\cdot i_c(t)^2 dt \quad (1)$$

where, symbol "R" represents a resistor, and symbol "T" represents a charging time.

Also, a total electric charge amount "Q" which is charged into the electric double layer capacitor is given by the below-mentioned formula (2)

[Formula 2]

$$Q=\int_0^T i_c(t)dt \quad (2)$$

In this example, it is assumed that a charging current is constant when the total electric charge amount Q is charged into the electric double layer capacitor; a charging current is "$i_{C_TA}$" when the electric double layer capacitor is charged for a charging time "$T_A$"; and a charging current is "$i_{C_TB}$" when the electric double layer capacitor is charged for a charging time "$T_B$". Also, it is assumed that a relationship given by the below-mentioned formula (3) is established between the charging time $T_A$ and the charging time $T_B$:

[Formula 3]

$$T_B = k \cdot T_A \tag{3}$$

where, it is set to be k>1.

If this relationship is satisfied, a total electric charge amount Q when the electric double layer capacitor is charged for the charging time $T_A$ is given by the below-mentioned formula (4):

[Formula 4]

$$Q = \int_0^{T_A} i_{c_T_A}(t)dt = i_{c_T_A} \cdot T_A \tag{4}$$

Also, a total electric charge amount Q when the electric double layer capacitor is charged for the charging time $T_B$ is given by the below-mentioned formula (5):

[Formula 5]

$$Q = \int_0^{T_B} i_{c_T_B}(t)dt = i_{c_T_B} \cdot T_B = i_{c_T_B} \cdot k \cdot T_A \tag{5}$$

As a consequence, a relationship between the charging current "$i_{C_TA}$" and the charging current "$i_{C_TB}$" is given based upon the above-mentioned formulae (4) and (5) by the below-mentioned formula (6):

[Formula 6]

$$i_{c_T_B} = \frac{i_{c_T_A}}{k} \tag{6}$$

Also, a loss "$E_{LOSS_A}$" which occurs when the electric double layer capacitor is charged for the charging time $T_A$ is given based upon the above-mentioned formula (1) by the following formula (7):

[Formula 7]

$$E_{Loss_A} = \int_0^{T_A} R \cdot i_c(t)^2 dt = R \cdot i_{c_T_A}^2 \cdot T_A \tag{7}$$

As a consequence, a loss "$E_{LOSS_B}$" which occurs when the electric double layer capacitor is charged for the charging time $T_B$ is given based upon the above-mentioned formulae (1), (3), and (6) by the following formula (8):

[Formula 8]

$$E_{Loss_B} = \int_0^{T_B} R \cdot i_c(t)^2 dt = R \cdot i_{c_T_B}^2 \cdot T_B = R \cdot \frac{i_{c_T_A}^2}{k} \cdot T_A \tag{8}$$

As a consequence, a relationship between a loss "$E_{LOSS_A}$" which occurs when the electric double layer capacitor is charged for the charging time $T_A$ and the loss "$E_{LOSS_B}$" which occurs when the electric double layer capacitor is charged for the charging time $T_B$ is given based upon the above-mentioned formulae (7) and (8) by the following formula (9):

[Formula 9]

$$E_{Loss_B} = \frac{E_{Loss_A}}{k} \tag{9}$$

As apparent from the results, in the case where the same electric charge amount, namely, the same electric power amount is charged into the electric double layer capacitor, the longer the charging time becomes, the smaller the loss that occurs in the resistive component becomes. In other words, in order to charge the electric double layer capacitor with efficiency, a required minimum electric power amount must be charged thereinto by making the best use of an allowable time. Also, it is desirable that the charging is carried out at a constant current value.

Losses which are similar to the losses which occurred in such the equivalent series resistor of the electric double layer capacitor may also occur in a wiring line, a contact resistance, and a battery. As a consequence, in this example, the supply current calculating apparatus 28 calculates a supply electric power amount supplied to the second electric storage apparatus 22 in such a manner that at least an electric power amount consumed until the car 3 reaches the destination floor is stored in the second electric storage apparatus 22, and equalizes the calculated supply electric power amount in the stopping time of the car 3 to calculate a current value when the second electric storage apparatus 22 is supplied therewith. Also, the supply current control apparatus 25 controls the current when this current is supplied to the second electric storage apparatus 22 in such a manner that the current value becomes constant over the stopping time of the car 3.

The power converting apparatus 29 converts the electric power mode which has been stored in the second electric storage apparatus 22 (for instance, DC power mode) into the electric power mode which may be applied to the respective appliances provided in the car 3 (for instance, AC power mode), and thereafter, supplies the converted electric power to the respective appliances. Also, in the case where each of the motors 15 is rotated by a load given from each of the rollers 14 and is thus used as a generator, for instance, where the car 3 is being lowered, namely, where each of the motors 15 is operated in a regenerative drive mode, the power converting apparatus 29 converts the electric power mode derived from each of the motors 15 into an electric power mode which can be stored in the second electric storage apparatus 22, and then supplies the converted electric power to the second electric storage apparatus 22. Alternatively, the electric power derived from the second electric storage apparatus 22 may be directly supplied, without the intermediation of the power converting apparatus 29, with respect to an appliance which is operated by the DC electric power mode.

Next, operations will be described. Each of the first electric storage apparatuses 6 has been charged with the electric power from the commercial power supply 4 by the charging apparatus 5. When the car 3 lands at each of the elevator halls 2, the car-side connecting unit 26 is electrically connected to the hoistway-side connecting unit 27, so the electric power may be conducted from the first electric storage apparatus 6 to the car 3.

Thereafter, the electric power derived from the first electric storage apparatus 6 is supplied to the second electric storage apparatus 22 under control of the supply current control apparatus 25. At this time, the supply current control apparatus 25 controls a current which is supplied to the second electric storage apparatus 22 based upon a current value calculated by the supply current calculating apparatus 28. In this example, the current which is supplied to the second electric storage apparatus 22 is controlled by the supply current control apparatus in such a manner that this current is continuously supplied during a stopping time of the car 3, and that the current value thereof becomes constant.

When the supply of the electric power to the second electric storage apparatus 22 is accomplished and a car call registration is carried out by at least one of the respective hall operating panels 7 and the car operating panel 10, the electric power stored in the second electric storage apparatus 22 is supplied via the power converting apparatus 29 and the motor driving apparatus 20 to the respective motors 15 by the control of the operation control apparatus 19. As a result, the respective motors 15 are operated to rotate the respective rollers 14. Accordingly, the car 3 is moved to a destination floor at which the car call is registered.

When the car 3 arrives at the destination floor, the car-side connecting unit 26 is electrically connected to the hoistway-side connecting unit 27, so the electric power from the first electric storage apparatus 6 can be again conducted to the car 3. In other words, the electric power can be again supplied to the second electric storage apparatus 22. Thus, it is possible to prevent shortage of the electric power amount stored in the second electric storage apparatus 22 from occurring.

When the electric power stored in the first electric storage apparatus 6 is consumed, electric power derived from the commercial power supply 4 is gradually charged into the first electric storage apparatus 6 under control of the charging apparatus 5.

In the above-mentioned power supplying system for an elevator, the electric power derived from the commercial power supply is charged into the first electric storage apparatus 6 by the charging apparatus 5, and the electric power derived from the first electric storage apparatus 6 is supplied by the electric power supplying apparatus 23 to the second electric storage apparatus 22 for storing thereinto the electric power for operating the appliances of the elevator. As a result, the electric power stored in the first electric storage apparatus 6 can be supplied to the second electric storage apparatus 22, and therefore, it is possible to avoid a shortage of the electric power amount which is supplied to the appliances of the elevator. Also, since the electric power derived from the commercial power supply 4 can be gradually charged into the first electric storage apparatus 6 by the charging apparatus 5, it is possible to prevent the electric power amount derived from the commercial power supply 4 from increasing excessively, and therefore, the variations of the electric power amount derived from the commercial power supply 4 can be reduced.

For example, in the case of an elevator specified such that a raising/lowering distance is 150 meters, a speed of the car 3 is 150 m/min, and a stopping time (i.e., door opening/closing time) of the car 3 is 5 seconds, a travel time of the car 3 from the lowermost floor to the uppermost floor is approximately 60 seconds. As a result, in order that the necessary electric power is supplied to the second electric storage apparatus 22 within 5 seconds, namely, the stopping time of the car 3, there is required an electric power which is approximately 12 times higher than the average consumed electric power. Since the electric power which is approximately 12 times higher than the averaged consumed electric power is supplied from the first electric storage apparatus 6, it is possible to prevent the electric power amount derived from the commercial power supply 4 from increasing excessively, and therefore, the variations of the electric power amount derived from the commercial power supply 4 can be reduced.

Also, the electric power supplying apparatus 23 is equipped with the supply current control apparatus 25 for controlling the current from the first electric storage apparatus 6 to the second electric storage apparatus 22, so the electric power derived from the first electric storage apparatus 6 can be supplied to the second electric storage apparatus 22 with efficiency.

Also, since the second electric storage apparatus 22 is mounted on the car 3, the car 3 can be driven in the self-drive system, and the structure of the elevator can be made simpler.

Also, the electric power mode is converted by the power converting apparatus 29 between the electric power mode for operating the appliances of the elevator and the electric power mode to be stored in the second electric storage apparatus 22, so the electric power which has been stored in the second electric storage apparatus 22 can be employed to operate the appliances of the elevator. Also, in the case where the car 3 is driven by the self-drive system, the electric power generated in the motor 15 during the operation of the regenerative drive of the elevator can be stored in the second electric storage apparatus 22, and thus, the electric power amount supplied from the first electric storage apparatus 6 to the second electric storage apparatus 22 can be reduced. As a consequence, both the second electric storage apparatus 22 and the electric power supplying apparatus 23 can be made compact.

Also, the electric connecting apparatus 24 contains the car-side connecting unit 26 provided to the car 3, and the hoistway-side connecting unit 27 provided in the hoistway 1, which is electrically connected to the car-side connecting unit 26 when the car 3 is kept landed at each of the elevator halls 2. As a result, when the car 3 lands at each of the elevator halls 2, the electric power derived from the first electric storage apparatus 6 can be more securely supplied to the second electric storage apparatus 22 with a simple structure.

Also, the supply current calculating apparatus 28 calculates the current value at which the current is supplied to the second electric storage apparatus 22 based upon the electric power amount which has been stored in the second electric storage apparatus 22, the travel distance of the car 3 up to the destination floor, and the stopping time during which the car 3 is kept stopped at each of the elevator halls 2. As a result, the required minimum supply electric power amount can be supplied to the second electric storage apparatus 22 within the stopping time of the car 3, so the electric power derived from the first electric storage apparatus 6 can be supplied to the second electric storage apparatus 22 with higher efficiency.

Also, the supply current control apparatus 25 controls the current which is supplied to the second electric storage apparatus in such a manner that the current value becomes constant. Asa result, the necessary supply electric power amounts are equalized within the stopping time, so the equalized necessary supply electric power amount can be supplied to the second electric storage apparatus 22. Thus, the electric power derived from the first electric storage apparatus 6 can be supplied to the second electric storage apparatus 22 with higher efficiency.

While the operation control apparatus 19 for controlling the operations of the elevator has been mounted on the car 3, the information respectively derived from the elevator hall appliance and the hoistway built-in appliance is transmitted to the operation control apparatus 19 through wireless communication, so a control cable to the operation control apparatus 19 can be eliminated. As a consequence, it is possible to prevent a heavy load capable of destroying the balance of the car 3 due to a weight of the control cable from being applied thereto. Also, a layout for avoiding interference with the control cable is no longer required to be designed for the appliances provided in the hoistway 1, so a space saving effect can be achieved.

Embodiment 2

Figure 3:
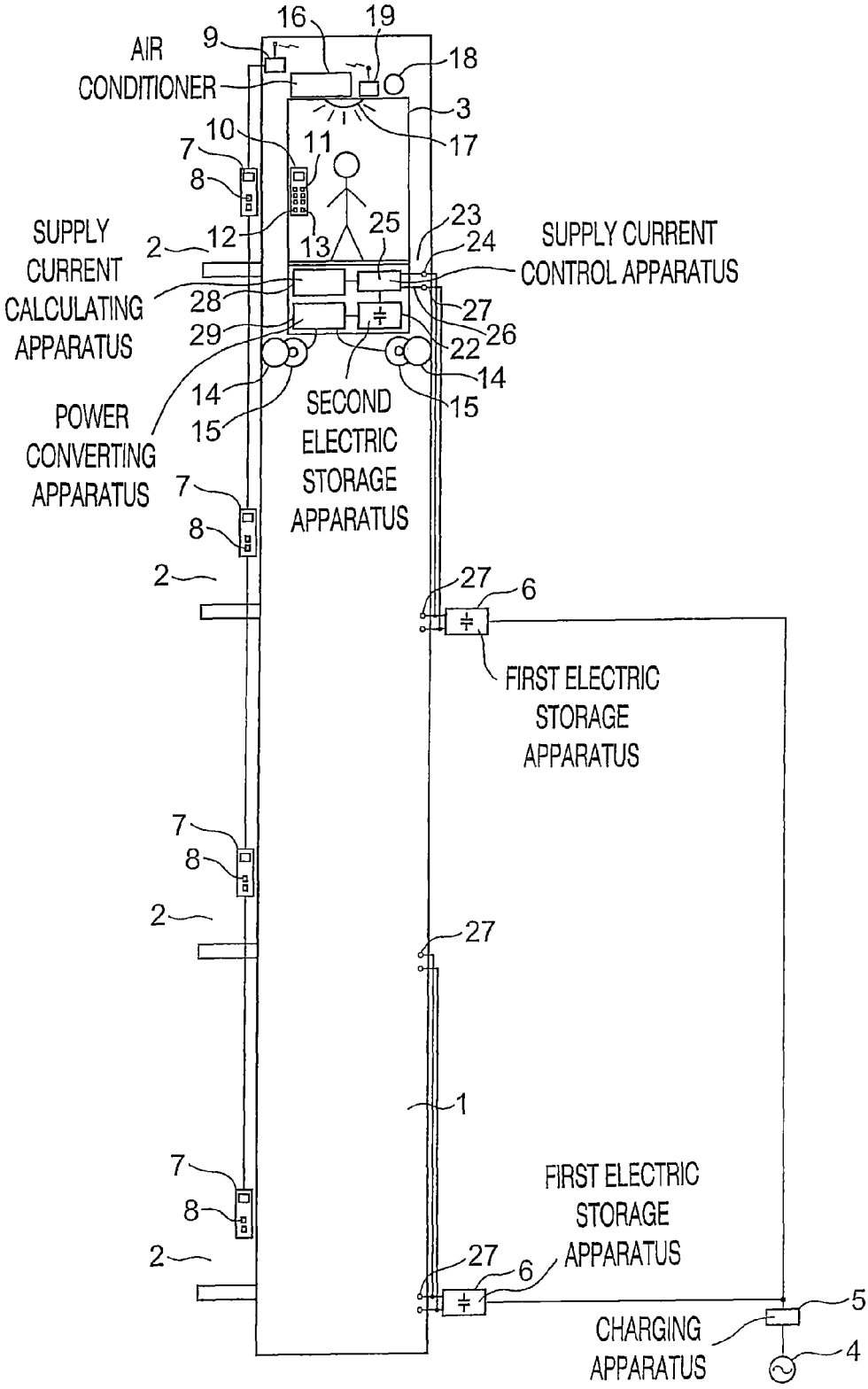
FIG. 3 is a structural diagram for indicating a power supplying system for an elevator according to a second embodiment of the present invention.

FIG. 3 is a structural diagram for indicating a power supplying system for an elevator according to a second embodiment of the present invention. In the drawing, the hoistway-side connecting units 27 provided on the respective floors are electrically connected to the same first electric storage apparatuses 6, respectively. In this example, the hoistway-side connecting units 27 provided on two floors are electrically connected to one electric storage apparatus 6. The first electric storage apparatus 6 is not provided on all of the floors and is provided only on few floors. It should be noted that other structures are similar to those of the first embodiment.

In the above-mentioned power supplying system for an elevator, the plurality of hoistway-side connecting units 27 are electrically connected to the same one of the first electric storage apparatuses 6, respectively, so a total number of the first electric storage apparatus 6 can be reduced, and thus, cost of the system can be reduced.

Embodiment 3

Figure 4:
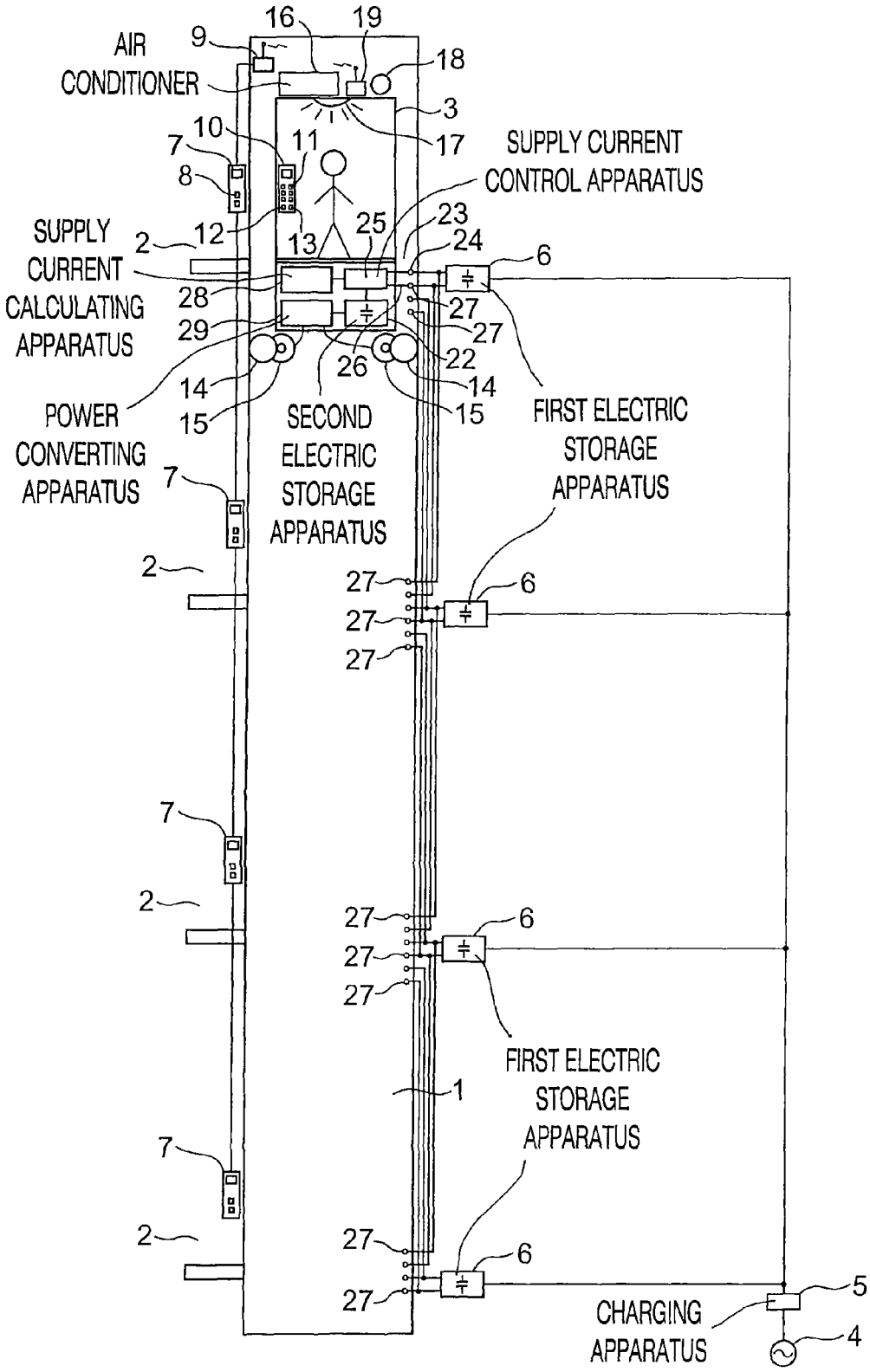
FIG. 4 is a structural diagram for indicating a power supplying system for an elevator according to a third embodiment of the present invention.

FIG. 4 is a structural diagram for indicating a power supplying system for an elevator according to a third embodiment of the present invention. In the drawing, a plurality of hoistway-side connecting units 27 are provided on each of the floors. To the plurality of hoistway-side connecting units 27 provided on the same floor, the first electric storage apparatuses 6 which are different from each other are electrically connected. When the car 3 is stopped at a predetermined power supplying position (in this example, when the car 3 is kept landed at each of the elevator halls 2), the car-side connecting unit 26 is designed to come into contact with the plurality of hoistway-side connecting units 27. In other words, when the car 3 is stopped at the predetermined power supplying position, the electric power can be supplied to the car-side connecting unit 26 from the plurality of hoistway-side connecting units 27 which are electrically connected to the first electric storage apparatuses 6 different from each other. Other structures of this system are similar to those of the first embodiment.

In the above-mentioned power supplying system for an elevator, when the car 3 is stopped at a predetermined power supplying position, the plurality of hoistway-side connecting units 27, which are electrically connected to the first electric storage apparatuses 6 different from each other, are made to come into contact with the car-side connecting unit 26, and the electric power derived from the plurality of first electric storage apparatuses 6 can be supplied to the second electric storage apparatus 22. Asa result, even in such a case that the electric power which has been stored in a portion of these first electric storage apparatuses 6 is reduced, the electric power derived from other first electric storage apparatuses 6 can be supplied, so the supply of the electric power to the second electric storage apparatus 22 can be carried out in a more stable manner.

For instance, in such a case that the car 3 lands at a specific elevator hall 2 and the electric power from the first electric storage apparatus 6 to the second electric storage apparatus 22 has been supplied, and thereafter, the car 3 is moved to another elevator hall 2, and immediately after this movement, the car 3 is again made to land at the above-mentioned specific elevator hall 2, there may be some cases where the charging operation for compensating the lost electric power due to supplying to the second electric storage apparatus 22 has not yet been accomplished in the first electric storage apparatus 6. Even in such the case, since the electric power from other first electric storage apparatuses 6 whose charging operations have been accomplished can be supplied to the second electric storage apparatus 22, the electric power can be supplied in a more stable manner, and also, the capacities of the respective first electric storage apparatuses 6 can be reduced. Further, cost reduction can be realized.

Embodiment 4

Figure 5:
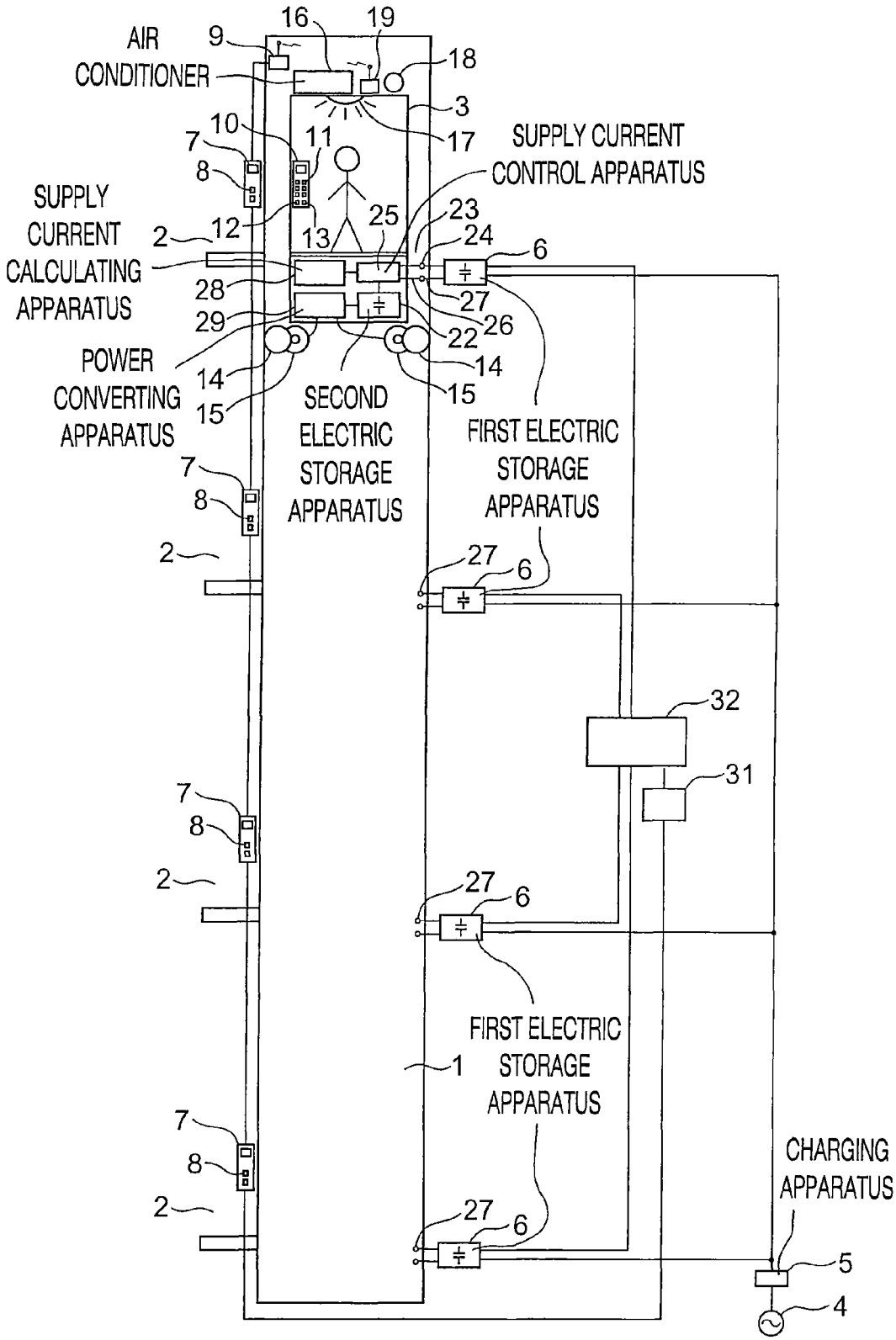
FIG. 5 is a structural diagram indicating a power supplying system for an elevator according to a fourth embodiment of the present invention.
Figure 6:
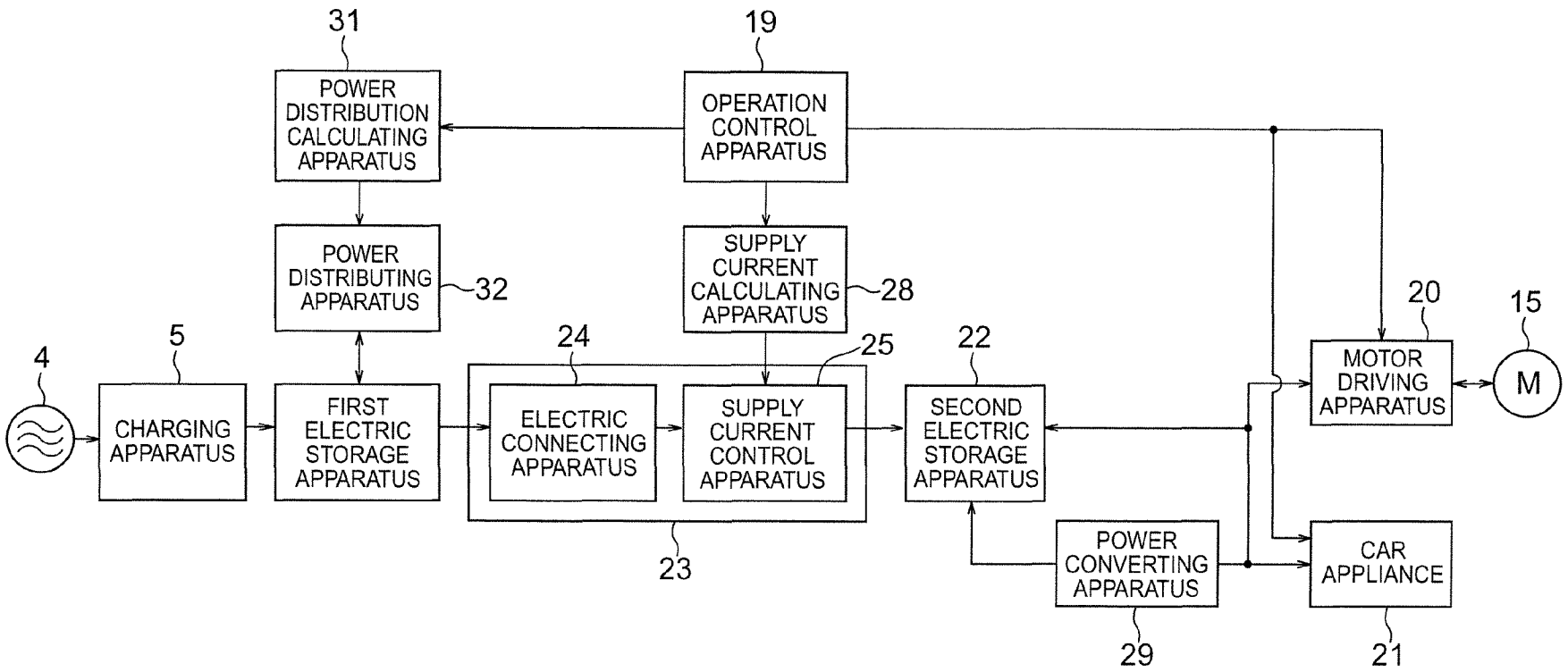
FIG. 6 is a block diagram showing the power supplying system for an elevator of FIG. 5.

FIG. 5 is a structural diagram indicating a power supplying system for an elevator according to a fourth embodiment of the present invention. FIG. 6 is a block diagram showing the power supplying system for an elevator of FIG. 5. In the drawings, both a power distribution calculating apparatus 31 and a power distributing apparatus 32 are installed in a building. The power distribution calculating apparatus 31 acquires a distribution of electric power amounts which are stored in a plurality of first electric storage apparatuses 6 respectively based upon information of a car call registration made by operating at least one of the respective elevator hall operating panels 7 and the car operating panel 10. The power distributing apparatus 32 supplies/receives electric power to/from the respective first electric storage apparatuses 6 based upon the information supplied from the power distribution calculating apparatus 31.

The information on the car call registration is inputted from the operation control apparatus 19 to the power distribution calculating apparatus 31. Further, the power distribution calculating apparatus 31 acquires a destination floor of the car 3 based upon the car call registration information, and calculates a distribution of electric power amounts which are stored in the respective first electric storage apparatuses 6 in such a manner that a distributed electric power amount to be stored in such a first electric storage apparatus 6 (hereinafter referred to as "destination floor electric storage apparatus") which is installed at the nearest floor with respect to the destination floor of the car 3 is larger than the distributed electric power amounts to be stored in other first electric storage apparatuses 6.

The power distributing apparatus 32 supplies/receives the electric power to/from the respective first electric storage apparatuses 6 in accordance with the distribution of the electric power amounts calculated in the power distribution calculating apparatus 31. In other words, the power distributing apparatus 32 performs the supply of the electric power to the destination floor electric storage apparatus from other first electric storage apparatuses 6 in such a manner that the electric power amount to be stored in the destination floor electric storage apparatus is larger than the electric power amounts to be stored in other first electric storage apparatuses 6. Also, the power distributing apparatus 32 calculates a travel time until the car 3 reaches to the destination floor, and supplies/receives the electric power to/from the respective first electric storage apparatuses 6 by utilizing the most of the travel time of the car 3. Other structures of this system are similar to those of the first embodiment.

In such a power supplying system for an elevator, the distribution of the electric power amounts which are stored in the respective first electric storage apparatuses 6 is calculated by the power distribution calculating apparatus 31 based upon the car call registration information, and the electric power is supplied to/received from the respective first electric storage apparatuses 6 by the power distributing apparatus 32 based upon the distribution of the electric power amounts calculated by the power distribution calculating apparatus 31. As a result, the supply of the electric power from the commercial power supply 4 can be further decreased, and the variation of the electric power amounts stored in the respective first electric storage apparatuses 6 can be further decreased. Further, since the distribution of the electric power amounts to be stored in the respective first electric storage apparatuses 6 is previously calculated, the electric power can be gradually supplied to/received from the respective first electric storage apparatuses 6 by utilizing the travel time of the car 3 until the car 3 reaches to the destination floor. As a consequence, the above-mentioned losses can be reduced which are produced by the respective resistive components contained in the respective first electric storage apparatuses 6 and the wiring lines.

It should be noted that in the first to fourth embodiments described above, a system applied to the electric connecting apparatus 24 is the contact system in which the electric connection is made by contacting the car-side connecting unit 26 and the hoistway-side connecting unit 27. Alternatively, a system applied to the electric connecting apparatus 24 may be a non-contact system in which electric power is supplied to a car-side connecting unit by using electromagnetic force exerted from a hoistway-side connecting unit under such a condition that the car-side connecting unit is separated from the hoistway-side connecting unit.

It should also be noted that in the above-mentioned first to fourth embodiments, the position of the car 3 when the car 3 arrives at each of the elevator halls 2 is defined as the predetermined power supplying position, but the structure is not limited thereto. Alternatively, for example, a position between the respective elevator halls 2 may be defined as the predetermined power supplying position.

It should also be noted that in the above-mentioned first to fourth embodiments, all of the capacities of the respective first electric storage apparatuses 6 are made to be equal to each other. Alternatively, the capacity of the first electric storage apparatus 6 which is electrically connected to the hoistway-side connecting unit 27 arranged at an intermediate portion of the hoistway 1 may be made smaller than the capacities of the first electric storage apparatuses 6 which are electrically connected to the hoistway-side connecting units 27 arranged on both the upper end portion and the lower end portion of the hoistway 1.

In the case where the car 3 which is being stopped at an intermediate floor of the hoistway 1 will be moved, a predictable maximum travel distance is nearly equal to a half of the entire raising/lowering distance of the car 3. In contrast, when the car 3 which is being stopped at either the uppermost floor or the lowermost floor of the hoistway 1 will be moved, a predictable maximum travel distance is nearly equal the entire raising/lowering distance of the car 3. In other words, an electric power amount which is required to be supplied to the second electric storage apparatus 22 when the car 3 is being stopped at the intermediate floor is smaller than that required when the car 3 is being stopped at either the uppermost floor or the lowermost floor. Under such the circumstances, the capacity of the first electric storage apparatus 6 for supplying the electric power to the hoistway-side connecting unit 27 arranged at the intermediate portion of the hoistway 1 may be made smaller than the capacities of the first electric storage apparatuses 6 for supplying the electric power to the hoistway-side connecting units 27 arranged on both the upper end portion and the lower end portion of the hoistway 1, resulting in the cost reduction.

Embodiment 5

Figure 7:
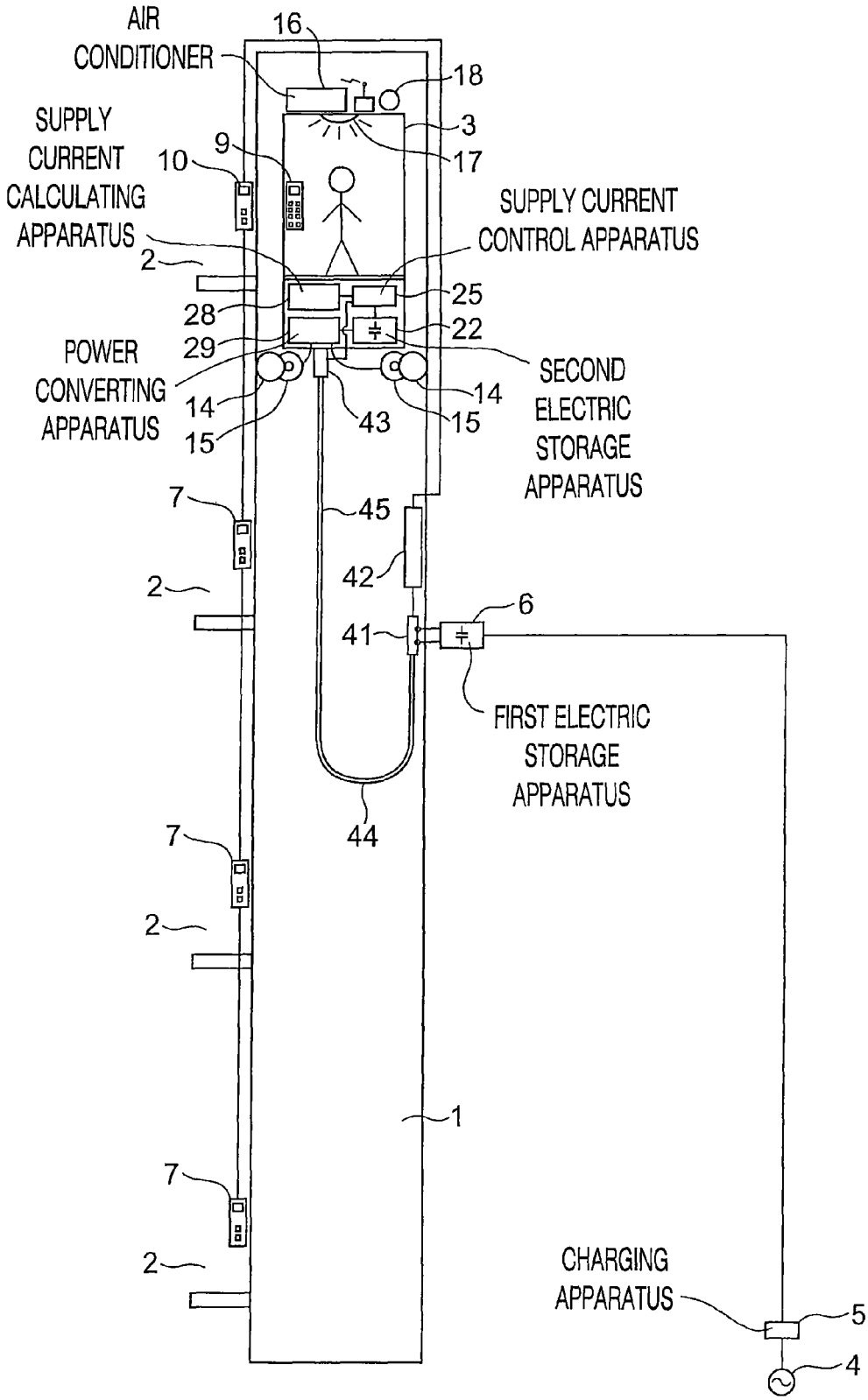
FIG. 7 is a structural diagram indicating a power supplying system for an elevator according to a fifth embodiment of the present invention.
Figure 8:
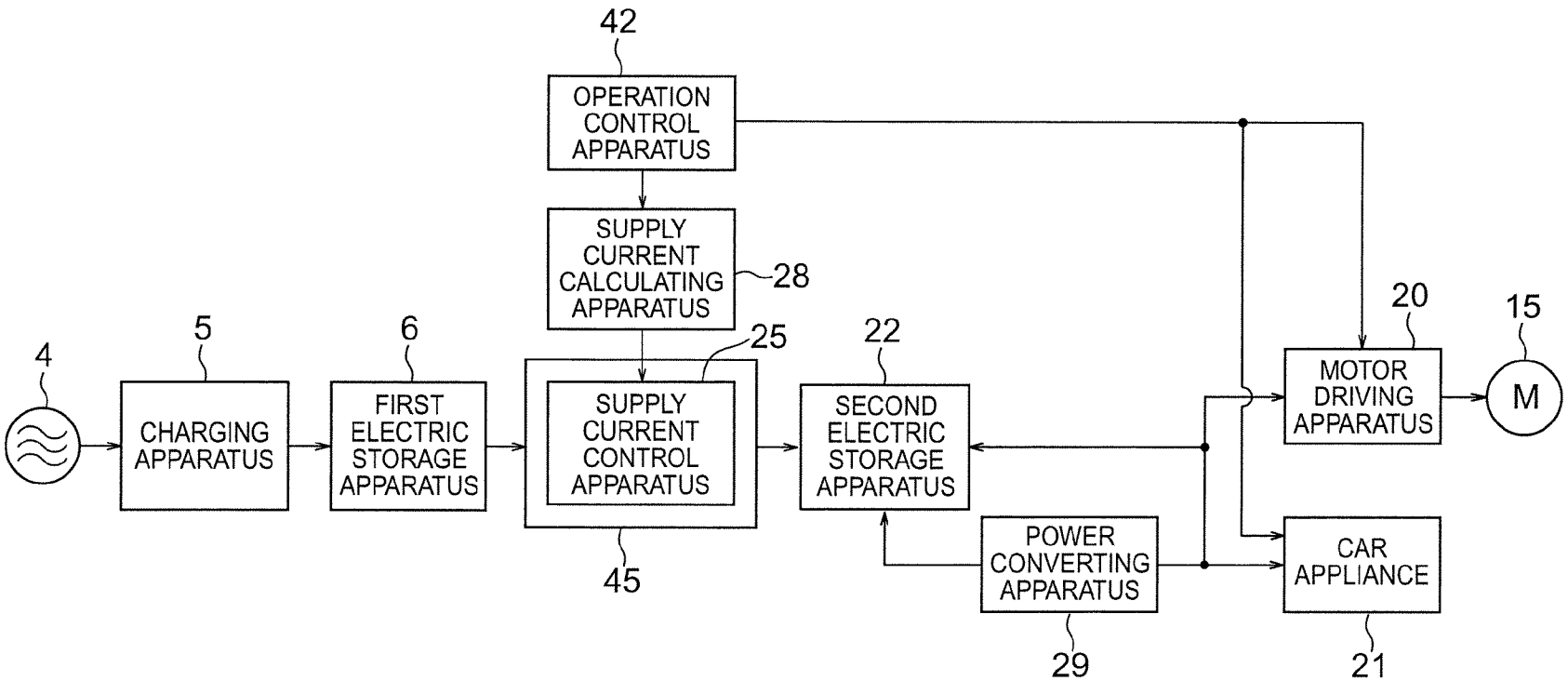
FIG. 8 is a block diagram showing the power supplying system for an elevator of FIG. 7.

FIG. 7 is a structural diagram indicating a power supplying system for an elevator according to a fifth embodiment of the present invention. Further, FIG. 8 is a block diagram showing the power supplying system for an elevator of FIG. 7. In the drawings, one of first electric storage apparatuses 6 is installed in a building. A hoistway-side connecting box 41 is installed as a relay unit in the hoistway 1. Also, an operation control apparatus 42 for controlling operations of the elevator is installed in the hoistway 1. The hoistway-side connecting box 41, the elevator hall appliance, and the hoistway built-in appliance are electrically connected to the operation control apparatus 42.

A car-side connecting box 43 is installed as a relay unit in the car 3. The motor driving apparatus 20, the car appliance 21, and the supply current control apparatus 25 are electrically connected to the car-side connecting box 43.

A control cable (move cable) 44 including a signal line and a power line is connected between the hoistway-side connecting box 41 and the car-side connecting box 43. The electric power derived from the second electric storage apparatus 6 is supplied to the second electric storage apparatus 22 via the hoistway-side connecting box 41, the control cable 44, the car-side connecting box 43, and the supply current control apparatus 25. Further, information derived from the operation control apparatus 42 is transferred via the hoistway-side connecting box 41, the control cable 44, and the car-side connecting box 43 to the motor driving apparatus 20 and the car appliance 21.

The supply current calculating apparatus 28 calculates an electric power amount which is supplied to the second electric storage apparatus 22 based upon an electric power amount which has been stored in the second electric storage apparatus 22 and a travel distance of the car 3 to a destination floor, and then, calculates a current value when electric power is supplied to the second electric storage apparatus 22 by equalizing the calculated supplied electric power amounts within a predetermined time. The electric power amount to be supplied is obtained as follows. An electric power amount which is consumed until the car 3 reaches to the destination floor is calculated based upon the travel distance of the car 3, and the calculated consumed electric power amount is compared with the stored electric power amount in the second electric storage apparatus 22. In other words, the electric power amount to be supplied is calculated in such a manner that a minimum electric power amount stored in the second electric storage apparatus 22 after the supply of the electric power has been completed is larger than the consumed electric power amount.

The supply current control apparatus 25 controls a current which is supplied to the second electric storage apparatus 22 based upon the information derived from the supply current calculating apparatus 28 in such a manner that the current value keeps a constant value during a predetermined time which has been set irrespective of a condition as to whether or not the car 3 is stopped. In this example, the above-mentioned predetermined time is defined by totalizing the stopping times of the car 3 and the travel time until the car 3 reaches to the destination floor.

It should also be noted that the power supplying apparatus 45 contains the hoistway-side connecting box 41, the car-side connecting box 43, the control cable 44, and the supply current control apparatus 25. Other structures of this system are similar to those of the first embodiment.

Next, operations of the power supplying system for an elevator will now be described. The first electric storage apparatus 6 has been charged by the charging apparatus 5 by receiving the electric power from the commercial power supply 4. When a car call is registered by operating at least any one of the respective elevator hall operating panels 7 and the car operating panel 10, a current value when electric power is supplied to the second electric storage apparatus 22 is calculated by the supply current calculating apparatus 28 based upon the car call registration information. Thereafter, the electric power derived from the first electric storage apparatus 6 is supplied to the second electric storage apparatus 22 under control of the supply current control apparatus 25. At this time, the control operation by the supply current control apparatus 25 for controlling the supply of the electric power is carried out based upon the current value calculated by the supply current calculating apparatus 28. Also, the supply of the electric power to the second electric storage apparatus 22 is carried out not only when the car 3 is stopped, but also when the car 3 is moved. In this example, the current which is supplied to the second electric storage apparatus 22 is controlled by the supply current control apparatus 25 in such a manner that the current is continuously supplied within a predetermined time and the current value keeps a constant value.

In such a case that the car 3 is moved to land at the destination floor, and thereafter, the car call registration is again performed, the above-mentioned operation is again carried out. As a result, the supply of the electric power to the second electric storage apparatus 22 is carried out, and thus, it is possible to prevent a shortage of the electric power amount stored in the second electric storage apparatus 22.

When the electric power stored in the first electric storage apparatus 6 is consumed, electric power derived from the commercial power supply 4 is gradually charged thereinto under control of the charging apparatus 5.

In such a power supplying system for an elevator, the control cable 44 is connected between the hoistway-side connecting box 41 provided in the hoistway 1 and the car-side connecting box 43 provided in the car 3, and thus, the electric power derived from the first electric storage apparatus 6 can be supplied to the second electric storage apparatus 22 via the control cable 44. As a consequence, the electric power derived from the first electric storage apparatus 6 can be supplied to the second electric storage apparatus 22 not only when the car 3 is stopped, but also when the car 3 is moved. Asa result, the time duration required for equalizing the electric power amounts supplied to the second electric storage apparatus 22 can be prolonged, and the current value when the electric power is supplied to the second electric storage apparatus 22 can be further decreased. As a consequence, the size of the power line of the control cable 44 can be reduced, and a total number of core lines of the control cable 44 may be reduced. Further, since variations of currents flowing through a power line can be decreased, even if both the power line and a signal line are arranged within a single control cable, an adverse influence caused by electromagnetic noise given from the power line to the signal line can be reduced.

It should also be noted that in each of the above-mentioned embodiments, both the supply current control apparatus 25 and the supply current calculating apparatus 28 are mounted on the car 3. Alternatively, at least any one of the supply current control apparatus 25 and the supply current calculating apparatus 28 may be mounted on the hoistway 1 side.

Further, in the above-mentioned embodiments, the present invention is applied to the car 3 on which the motors 15 are mounted and which serves as a self-drive type elevator. Alternatively, the present invention may be applied to such a rope type elevator that a car hung by a rope is driven by receiving drive force of a hoisting machine. Even in such the rope type elevator, the electric power derived from the first electric storage apparatus 6 may be supplied to the second electric storage apparatus 22, and the electric power derived from the commercial power supply 4 may be gradually charged to the first electric storage apparatus 6 by the charging apparatus 5. As a consequence, variations of the electric power amounts supplied to the appliances of the elevator may be rather decreased by the first and second electric storage apparatuses 6 and 22, and the variations of the electric power amount derived from the commercial power supply 4 may be decreased.

The invention claimed is:

1. A power supplying system for an elevator having an elevator car capable of stopping at two vertically spaced locations, comprising:

a first electric storage apparatus provided at each of said vertically spaced locations for storing thereinto electric power derived from a commercial power supply;

a charging apparatus for charging the electric power derived from the commercial power supply to each of the first electric storage apparatuses and for controlling a current when the electric power is charged into each of the first electric storage apparatuses;

a second electric storage apparatus mounted at the elevator car for storing thereinto electric power used to operate an appliance of the elevator car; and a power supplying apparatus for supplying the electric power derived from one of the first electric storage apparatuses to the second electric storage apparatus when the elevator car is stopped at one of the vertically spaced locations corresponding to the one of the first electric storage apparatuses.

2. A power supplying system for an elevator according to claim 1, wherein the power supplying apparatus includes a supply current control apparatus for controlling a current from the one of the first electric storage apparatuses to the second electric storage apparatus.

3. A power supplying system for an elevator according to claim 1, wherein further comprising a power converting apparatus capable of converting an electric power mode between an electric power mode for operating the appliance of the elevator car and an electric power mode to be stored in the second electric storage apparatus.

4. A power supplying system for an elevator according to claim 2, wherein:

the supply current control apparatus controls the current from the one of the first electric storage apparatuses to the second electric storage apparatus so that a current value keeps a constant value for a predetermined time.

5. A power supplying system for an elevator according to claim 1, further comprising an electric connecting apparatus including a car-side connecting unit provided in the elevator car and a hoistway-side connecting unit provided in the hoistway capable of supplying electric power to the car-side connecting unit.

6. A power supplying system for an elevator, comprising:

a first electric storage apparatus for storing thereinto electric power derived from a commercial power supply;

a charging apparatus for charging the electric power derived from the commercial power supply to the first electric storage apparatus and for controlling a current when the electric power is charged into the first electric storage apparatus;

a second electric storage apparatus for storing thereinto electric power used to operate an appliance of an elevator; and a power supplying apparatus for supplying the electric power derived from the first electric storage apparatus to the second electric storage apparatus, wherein the power supplying apparatus includes an electric connecting apparatus capable of supplying the electric power from the first electric storage apparatus to the second electric storage apparatus only when the car is stopped at a predetermined power supplying position within the hoistway; and the electric connecting apparatus includes a car-side connecting unit provided in the car and a hoistway-side connecting unit provided in the hoistway capable of supplying electric power to the car-side connecting unit when the car is stopped at the predetermined power supplying position, wherein:

the power supplying system for an elevator further comprises a supply current calculating apparatus for calculating a current value to be supplied to the second electric storage apparatus based upon a stored electric power amount which has been stored in the second electric storage apparatus, a stopping time during which the car is kept stopped at the predetermined power supplying position, and a travel distance of the car to a destination floor; and further comprising a supply current control apparatus that controls a current when the current is supplied from the first electric storage apparatus to the second electric storage apparatus based upon the information derived from the supply current calculating apparatus.

7. A power supplying system for an elevator according to claim 6, wherein the supply current control apparatus controls the current so that the current value supplied during the stopping time keeps a constant value.

8. A power supplying system for an elevator according to claim 5, wherein:

the plurality of hoistway-side connecting units are arranged in the hoistway with an interval therebetween in a height direction of the hoistway; and each of the hoistway-side connecting units are electrically connected to the first electric storage apparatus which is commonly used.

9. A power supplying system for an elevator according to claim 5, wherein when the car is stopped at the predetermined power supplying position, the electric power can be supplied to the car-side connecting unit from the plurality of hoistway-side connecting units which are electrically connected to the first electric storage apparatuses.

10. A power supplying system for an elevator, comprising:

a first electric storage apparatus for storing thereinto electric power derived from a commercial power supply;

a charging apparatus for charging the electric power derived from the commercial power supply to the first electric storage apparatus and for controlling a current when the electric power is charged into the first electric storage apparatus;

a second electric storage apparatus for storing thereinto electric power used to operate an appliance of an elevator; and a power supplying apparatus for supplying the electric power derived from the first electric storage apparatus to the second electric storage apparatus, wherein the power supplying apparatus includes an electric connecting apparatus capable of supplying the electric power from the first electric storage apparatus to the second electric storage apparatus only when the car is stopped at a predetermined power supplying position within the hoistway; and the electric connecting apparatus includes a car-side connecting unit provided in the car and a hoistway-side connecting unit provided in the hoistway capable of supplying electric power to the car-side connecting unit when the car is stopped at the predetermined power supplying position, wherein:

the predetermined power supplying positions are defined as landing positions where the car lands on a plurality of elevator halls; and the power supplying system for an elevator further comprises:

a power distribution calculating apparatus for calculating a distribution of electric power amounts which are respectively stored in the plurality of first electric storage apparatuses based upon information on a hall call registration derived by operating an operating panel provided in at least one of the car and the elevator hall; and a power distributing apparatus for supplying/receiving electric power to/from the respective first electric storage apparatuses based upon the information derived from the power distribution calculating apparatus.

11. A power supplying system for an elevator, comprising:

a first electric storage apparatus for storing thereinto electric power derived from a commercial power supply;

a charging apparatus for charging the electric power derived from the commercial power supply to the first electric storage apparatus and for controlling a current when the electric power is charged into the first electric storage apparatus;

a second electric storage apparatus for storing thereinto electric power used to operate an appliance of an elevator; and a power supplying apparatus for supplying the electric power derived from the first electric storage apparatus to the second electric storage apparatus, wherein the power supplying apparatus includes an electric connecting apparatus capable of supplying the electric power from the first electric storage apparatus to the second electric storage apparatus only when the car is stopped at a predetermined power supplying position within the hoistway; and the electric connecting apparatus includes a car-side connecting unit provided in the car and a hoistway-side connecting unit provided in the hoistway capable of supplying electric power to the car-side connecting unit when the car is stopped at the predetermined power supplying position, wherein:

the plurality of hoistway-side connecting units are arranged in the hoistway with an interval therebetween in the height direction of the hoistway; and a capacity of the first electric storage apparatus which is electrically connected to the hoistway-side connecting unit arranged at an intermediate portion of the hoistway is made smaller than a capacity of the first electric storage apparatus which is electrically connected to the hoistway-side connecting unit arranged at an end portion of the hoistway.

12. A power supplying system for an elevator according to claim 5, wherein:

an operation control apparatus for controlling an operation of the elevator is mounted on the car; and information derived from appliances which are provided to the hoistway and the elevator hall is transmitted to the operation control apparatus by wireless communication.

* * * * *